United States Patent [19]

Smith

[11] 4,229,902

[45] Oct. 28, 1980

[54] AUGMENTED BUBBLE BLOWER DEVICE

[76] Inventor: Forrest D. Smith, P.O. Box 3784, Eureka, Calif. 95501

[21] Appl. No.: 903,742

[22] Filed: May 8, 1978

[51] Int. Cl.[3] ..... A63H 33/28

[52] U.S. Cl. ..... 46/6

[58] Field of Search ..... 46/6, 7, 44, 53, 56; 239/429; 431/351

[56] References Cited

U.S. PATENT DOCUMENTS

| | | | |
|---|---|---|---|
| 1,086,991 | 2/1914 | Boys | 46/6 |
| 2,205,028 | 6/1940 | Bloxom | 46/6 |
| 3,323,250 | 6/1967 | Gibbons | 46/6 |
| 3,613,293 | 10/1971 | Scott | 46/44 |
| 3,858,808 | 1/1975 | Dillon | 239/429 |

*Primary Examiner*—Louis G. Mancene
*Assistant Examiner*—Mickey Yu

[57] ABSTRACT

An augmented bubble blower device in which a mouthpiece tube is mounted for axial movement relative to a venturi tube. The discharge end of the tube is surrounded by an open chamber so that a jet of breath which is discharged from the mouthpiece tube along the longitudinal axis of the venturi tube draws air from the surrounding environment and carries that air with it into the venturi chamber. The remote end of the venturi chamber provides a support for the formation of a bubble from film-forming material stretched across the remote end of the venturi tube.

9 Claims, 3 Drawing Figures

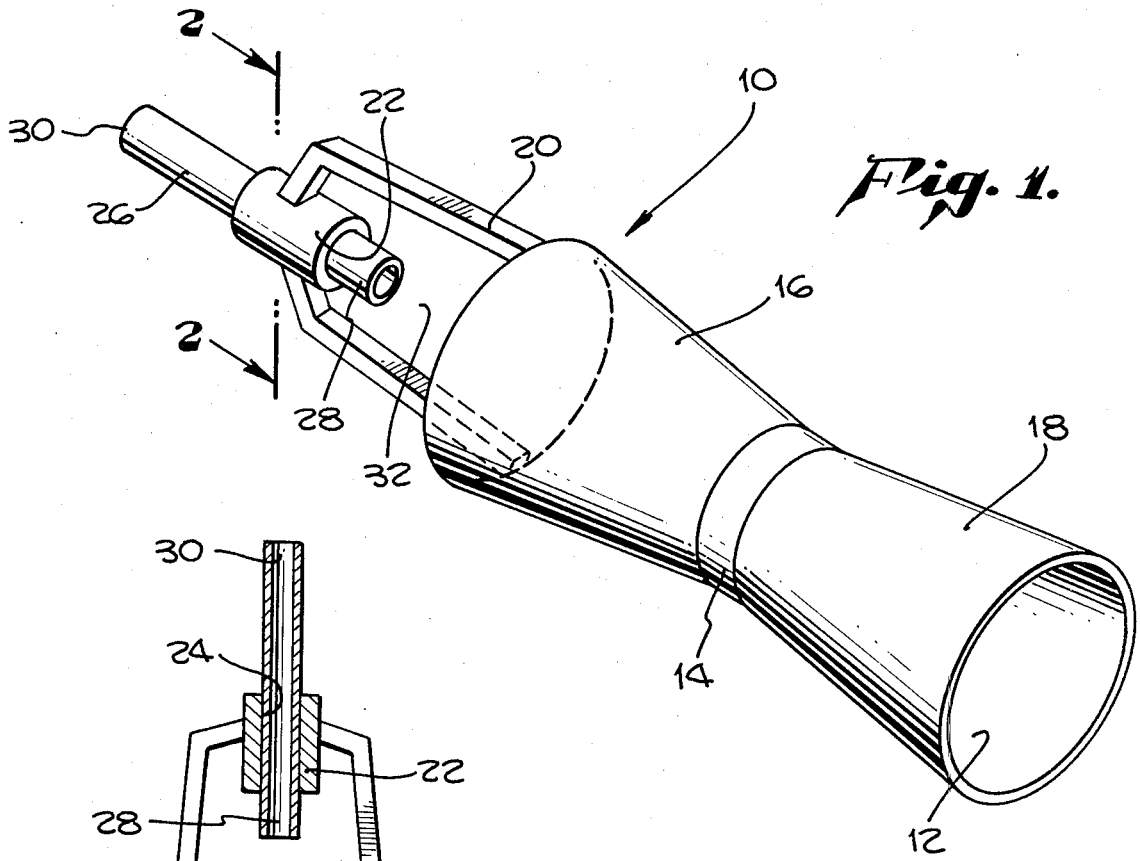
Fig. 1.
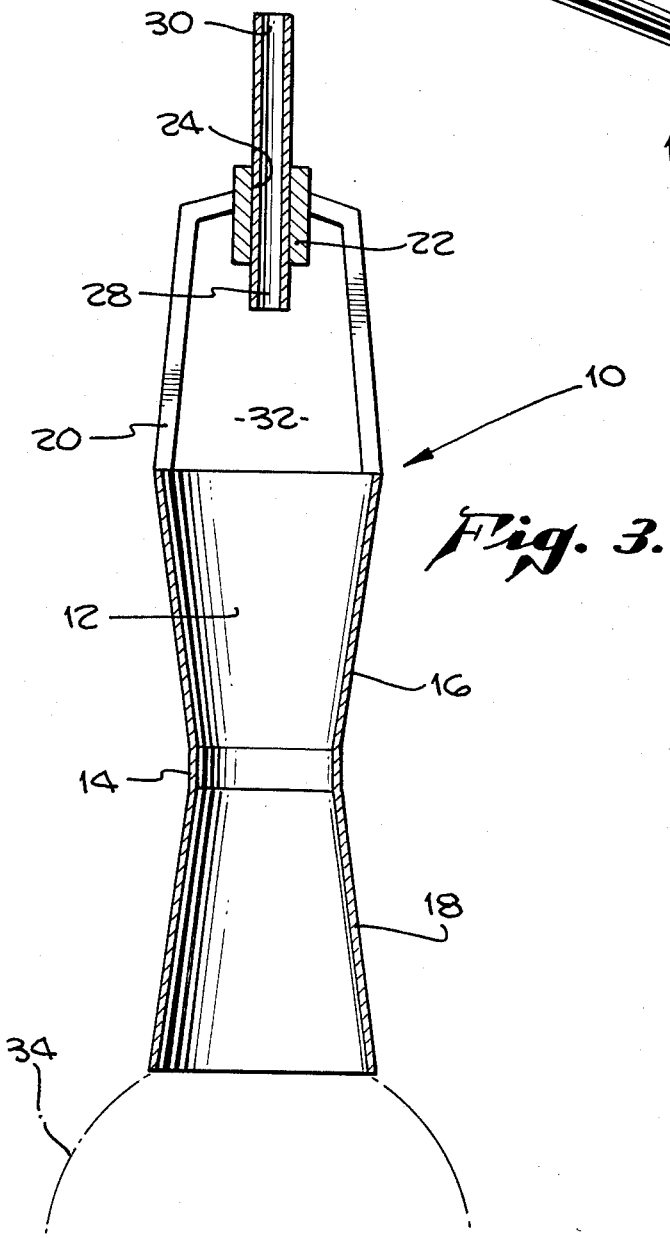
Fig. 3.
Fig. 2.
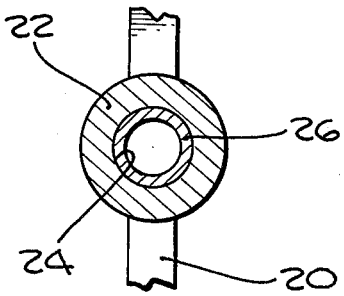

AUGMENTED BUBBLE BLOWER DEVICE

This invention relates to bubble blowing toys and in particular augmented bubble blowers wherein the volume of air supplied to the formation of a bubble greatly exceeds the volume of breath blown into the bubble forming device.

A great deal of pleasure and enjoyment may be had, particularly by children, in the blowing of bubbles with various bubble forming devices. It is particularly entertaining to blow the largest bubbles possible with a minimum amount of effort. Previously, considerable difficulty had been encountered in blowing very large bubbles because many breaths were required to accomplish the inflation of a large bubble. Hyperventilation became a problem and also bursting of the bubbles by reason of drying or some accident prevented the formation of very large bubbles. It was previously proposed by Bloxom U.S. Pat. No. 2,205,028, patented June 18, 1940, to provide a structure in which auxiliary air would be drawn in by a breath blown through a fixed mouthpiece across an open chamber and into the small end of a frusto-conical expansion chamber. A bubble toy proposed by Jianas et al U.S. Pat. No. 2,882,643, patented Apr. 21, 1959, includes a fixed nozzle separated by an open chamber from a bubble supporting ring. These prior expedients could not be adjusted to accommodate the lung force or preferred breath control mode of the operator. Also, the size of the bubbles formed with these prior expedients were not as large as desired. These and other difficulties of the prior art have been overcome according to the present invention, wherein an axially movable mouth tube is mounted so that it discharges breath into an open chamber upstream from the large end of an enclosed converging chamber which preferably forms one side of a venturi chamber. The axially adjustment of the discharge end of the mouthpiece relative to the location of the large end of the converging chamber permits the user of this bubble forming device to determine the optimum location for his lung volume and force relative to the size of bubble which it is desired to form. In general, bubbles as much as or greater than 40 times the volume of the breath blown into the mouthpiece tube can be formed, utilizing the structure of the present invention.

Referring particularly to the drawings for the purposes of illustration and not limitation, there is illustrated:

FIG. 1, a perspective view of a specific embodiment of the present invention;

FIG. 2, a cross-sectional view taken along line 2—2 in FIG. 1; and

FIG. 3, a cross-sectional view taken along line 3—3 in FIG. 1.

With specific reference to the drawings, there is illustrated generally at 10 an augmented bubble blower which includes a venturi chamber 12. Venturi chamber 12 is composed of a generally cylindrical center section 14 which forms a constricted throat area in the venturi chamber. A constriction chamber is defined by frusto-conical converging section 16. A diverging chamber is provided by frusto-conical release section 18. Sections 14, 16, and 18 are aligned axially on a common longitudinal axis. Open frame 20 projects axially outwardly from the large open end of converging section 16. Open frame 20 supports a bushing 22 which is provided with an axial bore 24. Axial bore 24 is substantially in axial alignment with the longitudinal axis of venturi chamber 12. A mouthpiece tube 26 is slidably received in axial bore 24 with its nozzle or discharge end 28 disposed so as to discharge the breath axially towards the large end of converging section 16. The mouthpiece end 30 of mouthpiece tube 26 is adapted to be blown into by the operator of this device. Venturi chamber 12 and its respective sections 14, 16, and 18 and mouthpiece 26 are all aligned on substantially a common longitudinal axis. Open chamber 32 surrounds the nozzle end 28 of mouthpiece tube 26. The large end of diverging section 18 serves to support the film-forming material of which bubble 34 is constructed.

In general, it is preferred that the constricting chamber be constructed so that its longitudinal axis is longer than the width of its largest end. Preferably, the constricted throat section of the venturi chamber should have a width which is no more than approximately three-quarters of the width of the large end of the constricting chamber. Preferably, the mouthpiece tube is supported so that the nozzle end may be positioned from the large end of the constricting chamber by a distance at least approximately equal to the width of the large end of the constricting chamber. Preferably the diameter of the axially projected jet of breath is small compared to the diameter of the large end of the converging chamber. A small volume of breath moving at a high velocity is preferred to a larger volume of breath moving at a smaller velocity. In general, the cross-sectional area of the nozzle end of the mouthpiece tube should be less than approximately one-tenth of the cross-sectional area of the large end of the constricting chamber and may be as much as one-fiftieth or less. Preferably the proportions of the diverging section of the venturi chamber are approximately the same as those of the converging section.

In use, the operator dips the end of the bubble forming device, which is remote from the mouthpiece end, in a film-forming liquid such as soapy water to form a film across the remote end of the device. The device is then positioned so that breath can be blown into the mouthpiece, and a bubble is formed by blowing through the mouthpiece. Repetition of this procedure utilizing different lung volumes and capacities and positionings of the nozzle end of the mouthpiece tube will reveal the optimum combination for the size of bubble which it is desired to form.

What has been described are preferred embodiments in which modifications and changes may be made without departing from the spirit and scope of the accompanying claims.

What is claimed is:

1. An augmented bubble blower device comprising:

a tubular member having a nozzle end for dicharging gas, an open chamber, a venturi chamber spaced from said nozzle end and having a longitudinal axis, said venturi chamber including in axial alignment a converging section adjacent said open chamber, a constricted throat section, and a diverging section, and means for slidable mounting said tubular member for movement along said longitudinal axis toward and away from said venturi chamber, said means for mounting positioning said tubular member so that said nozzle end is adapted to discharge gas into said open chamber toward said venturi chamber approximatly along said longitudinal axis whereby gas discharged from said nozzle end enters said venturi chamber and draws additional gas from said open chamber into said venturi chamber, and means for supporting a film of bubble forming material in position to receive gas after said gas passes through said diverging section.

2. An augmented bubble blower device of claim 1 wherein the length of said converging section is greater than its width.

3. An augmented bubble blower device of claim 1 wherein the width of said constricted throat section is less than three-quarters of the width of the widest part of said converging section.

4. An augmented bubble blowing device of claim 1 wherein said converging and diverging sections have about the same proportions.

5. An augmented bubble blower device comprising:

a gas conduit member having a discharge end for discharging a stream of gas, an open chamber surrounding said discharge end, an enclosed constricting chamber spaced from said discharge end and having a large end and a small end, means supporting said discharge end for movement toward and away from said large end, said discharge end being adapted to discharge said stream of gas into said large end, whereby said stream of gas draws additional gas to it so that an augmented gas stream flows into said constricting chamber, and means for supporting a film of bubble forming material in position to receive said augmented gas stream after said augmented gas stream passes through said constricting chamber.

6. An augmented bubble blower device of claim 5 wherein said constricting chamber is longer than the width of said large end.

7. An augmented bubble blower device comprising:

a tubular member having a discharge end for discharging gas, an open chamber surrounding said discharge end, an enclosed constricting chamber spaced from said discharge end and having a converging section with a large end and a small end, said discharge end being adapted to discharge gas into said large end, said tubular member being mounted for movement of said discharge end toward and away from said large end, and means for supporting a film of bubble forming material in position to receive said gas after said gas passes through said small end.

8. An augmented bubble blowing device of claim 7 including means for movably mounting said tubular member, said means for movably mounting permitting said discharge end to be positioned a distance from said large end at least as great as the width of said large end.

9. An augmented bubble blower device of claim 7 including an expansion chamber integral and axially aligned with said converging section to form a venturi chamber.

* * * * *